US009096350B2

(12) United States Patent
Buerk

(10) Patent No.: US 9,096,350 B2
(45) **Date of Patent: *Aug. 4, 2015**

(54) DEBRIS RECEPTACLE REMOVABLY SECURED TO EDGE OF WORK SURFACE

(71) Applicant: Mark Buerk, Seattle, WA (US)

(72) Inventor: Mark Buerk, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/058,148

(22) Filed: Oct. 18, 2013

(65) Prior Publication Data

US 2014/0042174 A1 Feb. 13, 2014

Related U.S. Application Data

(63) Continuation-in-part of application No. 13/044,469, filed on Mar. 9, 2011, now Pat. No. 8,584,888.

(60) Provisional application No. 61/313,457, filed on Mar. 12, 2010.

(51) Int. Cl.

| | |
|---|---|
| ***B65D 25/22*** | (2006.01) |
| ***B65D 25/20*** | (2006.01) |
| ***B65F 1/14*** | (2006.01) |
| *A47B 96/06* | (2006.01) |

(52) U.S. Cl.

CPC ..... *B65D 25/20* (2013.01); *B65F 1/141* (2013.01); *B65F 2210/18* (2013.01); *Y10T 29/49826* (2015.01)

(58) Field of Classification Search

CPC ..... A47B 97/00; A47B 2200/09; A47B 2097/00; F16M 13/02; F16M 2200/02

USPC ..... 220/608, 482, 478, 479, 480; 248/579, 248/617, 447.2, 154, 213.2, 214

See application file for complete search history.

(56) References Cited

U.S. PATENT DOCUMENTS

| | | | |
|---|---|---|---|
| 2,642,038 | A | 6/1953 | Howling |
| 3,744,645 | A | 7/1973 | Hochman |
| 3,748,006 | A | 7/1973 | Levit et al. |
| 4,109,889 | A | 8/1978 | Durket |

(Continued)

FOREIGN PATENT DOCUMENTS

EP 0478511 A1 4/1992

OTHER PUBLICATIONS

"Cilio Tabletop Crumb Catcher," Tabletop Accessories: Fante's, retrieved from <<www.fantes.com/tabletop.html>>, retrieved on May 5, 2011, 2 pgs.

(Continued)

*Primary Examiner* — Mickey Yu
*Assistant Examiner* — Niki Eloshway
(74) *Attorney, Agent, or Firm* — Lee & Hayes, PLLC

(57) ABSTRACT

A debris receptacle is removably attachable to an edge or lip of a work surface. A debris receiving volume defined by a bottom surface and a rear panel is disposed between lower clamp arms that extend under a work surface and are biased toward upper clamp arms that extend over the work surface. Springs disposed within concentric columns that are coupled to the lower and upper clamp arms provide a biasing force, which urges the lower clamp arms toward the upper clamp arms to removably secure the debris receptacle to the edge of the work surface. The debris receptacle is thus mounted to receive debris swept from the work surface through a gap defined between the rear panel and the edge of the work surface.

27 Claims, 10 Drawing Sheets

(56) References Cited

U.S. PATENT DOCUMENTS

| | | | |
|---|---|---|---|
| 4,134,577 | A | 1/1979 | Price et al. |
| 4,155,310 | A | 5/1979 | Gregory |
| 4,487,523 | A | 12/1984 | Monroe |
| 4,530,539 | A | 7/1985 | Gaber et al. |
| 4,538,340 | A | 9/1985 | Ricke |
| 4,586,746 | A | 5/1986 | Day et al. |
| 4,613,995 | A | 9/1986 | Ricke |
| 4,799,858 | A | 1/1989 | Shin-Chin |
| 4,802,595 | A | 2/1989 | Northington |
| 4,832,299 | A | 5/1989 | Gorton et al. |
| 4,854,016 | A | 8/1989 | Rice |
| 4,901,969 | A | 2/1990 | Yaeger |
| 5,367,959 | A | 11/1994 | Allen et al. |
| 5,456,046 | A | 10/1995 | Vitalune et al. |
| 5,497,706 | A | 3/1996 | Yong |
| 5,609,318 | A | 3/1997 | Scheh |
| 5,954,589 | A | 9/1999 | Masters |
| 5,979,855 | A | 11/1999 | Maier |
| 5,996,983 | A | 12/1999 | Laurenzi |
| 6,026,972 | A | 2/2000 | Makowski |
| 6,073,897 | A | 6/2000 | Warren et al. |
| 7,159,832 | B2 | 1/2007 | Easterling |
| 7,284,737 | B2 | 10/2007 | Kane |
| 7,290,490 | B2 | 11/2007 | Goldberg et al. |
| D556,531 | S | 12/2007 | Allen |
| 7,469,425 | B2 | 12/2008 | DeStefano |
| 7,578,234 | B2 | 8/2009 | Sumner |
| 7,793,905 | B2 | 9/2010 | Merritt et al. |
| 8,313,069 | B2 | 11/2012 | Yim et al. |
| 2001/0032915 | A1 | 10/2001 | Clifford |
| 2004/0120607 | A1 | 6/2004 | Goren |
| 2005/0056746 | A1 | 3/2005 | Landver |
| 2005/0279749 | A1 | 12/2005 | Karrasch et al. |
| 2006/0016953 | A1 | 1/2006 | Beck et al. |
| 2006/0284041 | A1 | 12/2006 | Segretto |
| 2007/0272804 | A1 | 11/2007 | Tisdale |
| 2008/0178772 | A1 | 7/2008 | Roach |
| 2010/0163702 | A1 | 7/2010 | Lagobi |

OTHER PUBLICATIONS

Non-Final Office Action for U.S. Appl. No. 13/044,469, mailed on Dec. 21, 2012, Mark Buerk, "Debris Receptacle Removably Secured to Edge of Work Surface", 5 pages.

DEBRIS RECEPTACLE REMOVABLY SECURED TO EDGE OF WORK SURFACE

RELATED APPLICATIONS

This application is a continuation-in-part of a prior copending patent application, Ser. No. 13/044,469, filed on Mar. 9, 2011, which is based on a provisional application, Ser. No. 61/313,457, filed on Mar. 12, 2010, the benefit of the filing dates of which is hereby claimed under 35 U.S.C. §120 and 35 U.S.C. §119(e).

BACKGROUND

There are many activities that are carried out on a tabletop or countertop that produce debris. For example, in the kitchen, preparation of a salad using a cutting board for trimming vegetables typically produces small piles of waste such as carrot peels and onion trimmings. If the work surface is not next to a sink with a garbage receptacle, the piles of waste must be picked up and discarded in an appropriate container, such as a compostable waste bin or garbage bin.

Other tasks performed on work surfaces also produce very different types of waste. For example, someone who is using a pencil to prepare documents or complete forms often will need to erase erroneous entries, producing eraser crumbs that spread over the surface. Again, it will periodically be necessary to sweep the eraser crumbs into a pile that is picked up and discarded in a waste container using a brush and handheld dust pan or alternatively, swept into the waste container. It is not unusual for the process of collecting and transferring such debris to be less accurate than intended, so that some of the debris falls on the floor instead of into the waste container.

Hobbies that involve work at a table or bench also produce debris that must be removed from work surfaces and transferred into appropriate waste containers. Thus, the trimmings produced when tying fishing flies or lures are generally scattered around the fly tying vise that is mounted to the edge of a bench or countertop and must be periodically transferred to a waste receptacle. In each of the examples noted above, which are just a few of the many where waste debris accumulates on a work surface of a bench, tabletop, or countertop, it is clear that the task of removing the debris to clear the work surface is perhaps best accomplished by sweeping the debris into a waste container or dust pan. However, holding a heavy waste container in one hand while sweeping the debris from the work surface with the other hand is at best an awkward operation that requires some dexterity and skill to avoid dropping the waste container or missing the opening so that the debris falls to the floor. Even if a lighter weight dust pan is placed under the edge of the work surface to receive the debris, typically, at least some of the debris overshoots the dustpan or misses it and falls to the floor, so that a further cleaning operation is required to finish disposing of the debris.

Accordingly, it will be apparent that it would be desirable to provide a receptacle for such debris that need not be held while moving the debris from the work surface and into the receptacle. The receptacle should be affixed to the edge of a work surface to receive debris that is swept or otherwise moved into it from the work surface. It would also be desirable for the receptacle to be easily removable from the edge of the work surface to enable the debris collected therein to be emptied into a larger waste container, such as a garbage can. Such a device should more efficiently collect all of the debris on a work surface so that virtually none falls to the floor when the debris is moved into the receptacle affixed to the edge of the bench, countertop, desktop, or tabletop from which the debris is being removed. Further, it would be desirable to free up both hands for use when cleaning with the device, so that the user would be able to move things on a counter or other work surface and thoroughly clean. In addition, it would be desirable to provide a device that clamps on a work surface so that someone with limited use of both or just one hand can readily clean their work surface using the device

SUMMARY

This application specifically incorporates by reference the disclosures and drawings of each patent application and issued patent identified above as a related application.

The following disclosures describe exemplary embodiments of a debris receptacle that is removably secured to an edge of a work surface. A debris receiving volume in the debris receptacle is defined by the facing surfaces of two lower clamp arms that form the sides of the debris receiving volume. A rear surface, and a bottom surface also define the debris receiving volume, and the lower clamp arms are coupled to the rear surface and the bottom surface. Two upper clamp arms are coupled to the debris receiving volume. Each upper clamp arm extends adjacent to and overlying one of the lower clamp arms. The upper clamp arms and the lower clamp arms are thus disposed in opposition to each other and are movable relative to each other. A plurality of springs include at least one spring coupled between each of the opposing lower clamp arms and to upper clamp arms. These springs apply a biasing force to urge the lower clamp arms toward the upper clamp arms, causing the lower clamp arms and the upper clamp arms to grip opposite surfaces of a work surface and removably clamp and secure the debris receptacle at the edge of the work surface in a position to receive debris that is moved from the work surface and into the debris receiving volume.

Another aspect of this technology is directed to an exemplary method for enabling a debris receptacle to be removably attached to and supported by an outwardly extending edge of a work surface. This includes providing lower clamp arms disposed at each side of a debris receiving volume. The lower clamp arms are able to extend under the work surface when the debris receptacle is disposed adjacent to an edge of the work surface. Upper clamp arms are provided and are disposed in opposition to the lower clamp arms. These upper clamp arms are sized to extend over a top surface of the work surface when the debris receptacle is disposed at the edge of the work surface. A biasing force is applied between the lower clamp arms and the upper clamp arms. This biasing force tends to move the lower clamp arms relative to the upper clamp arms, to compress and clamp the edge of the work surface between the lower and upper clamp arms. Accordingly, the debris receptacle is removably secured on the edge of the work surface, enabling debris on the work surface to readily be moved from the work surface into the debris receiving volume.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 1:
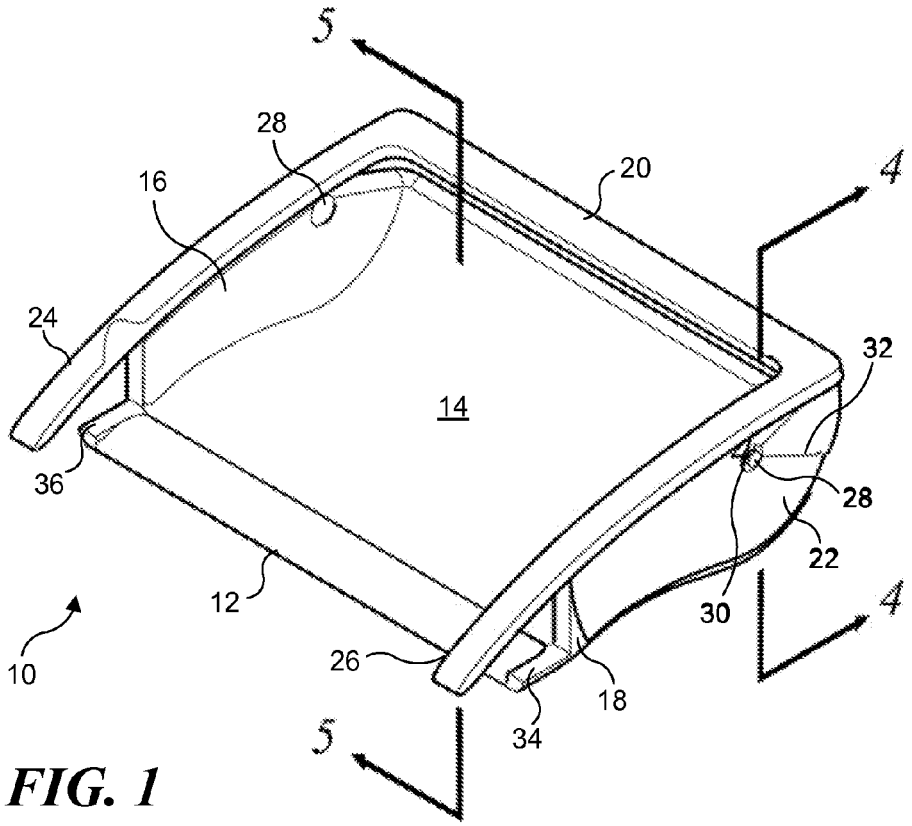
FIG. 1 is an isometric view of an exemplary embodiment of a debris receptacle that can be removably attached to an edge of a work surface.
Figure 2:
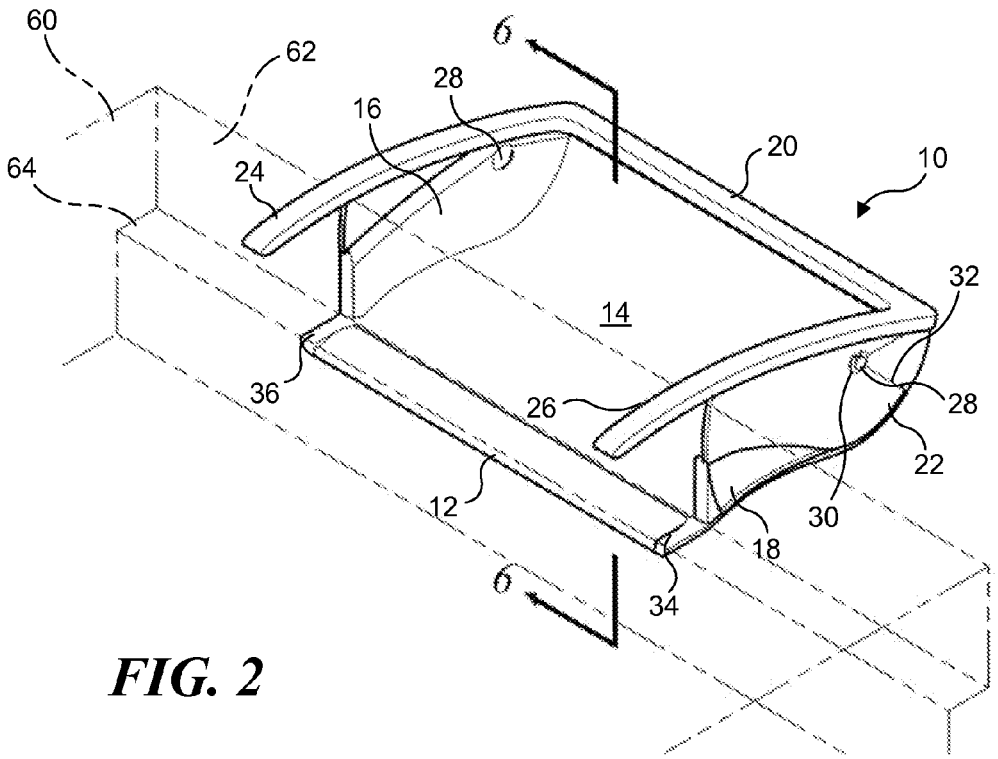
FIG. 2 is an isometric view of the exemplary embodiment of FIG. 1, illustrating how the debris receptacle is attached to an edge of a counter, bench, or table, which is shown in phantom view.
Figure 3:
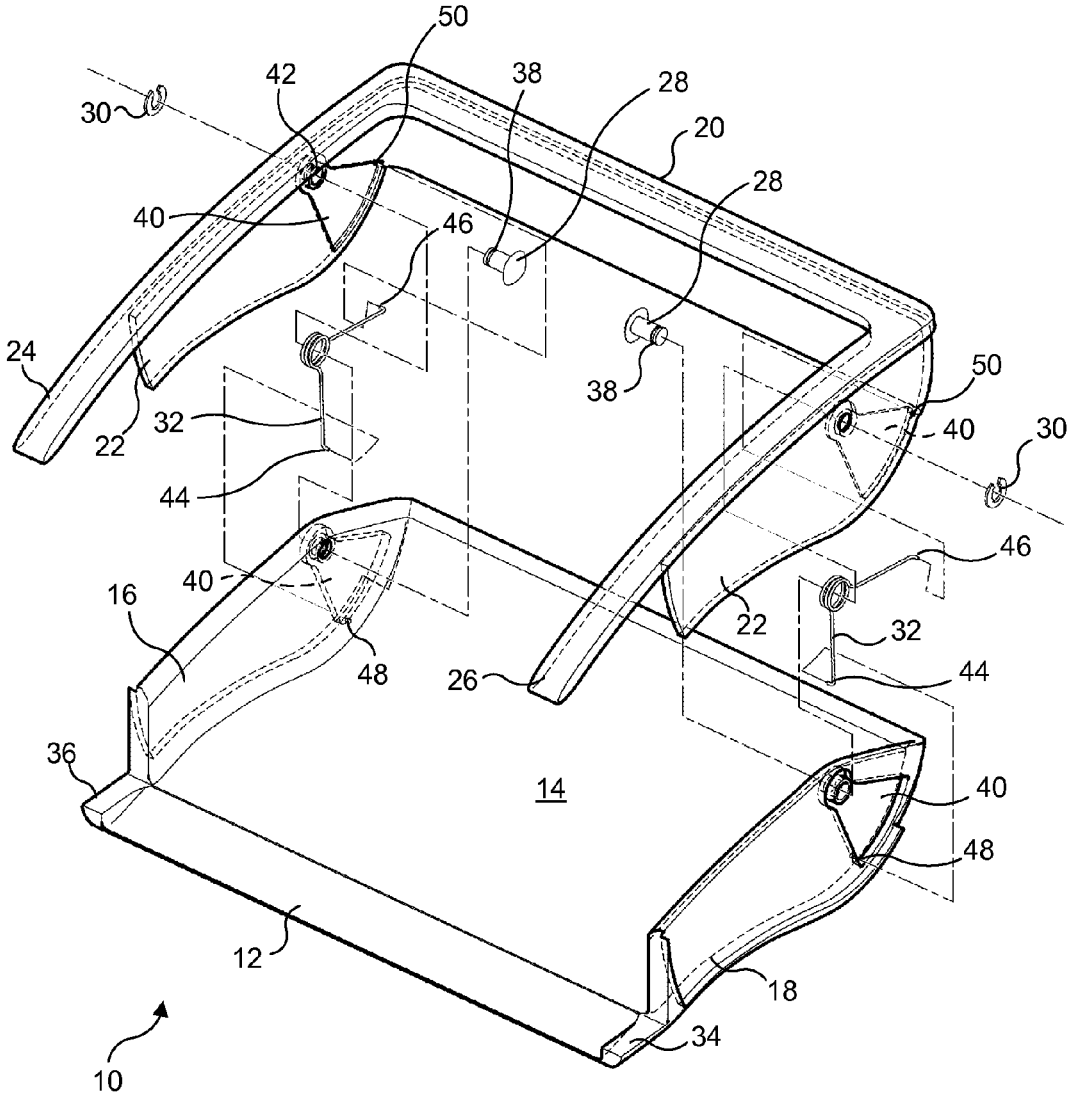
Figure 4:
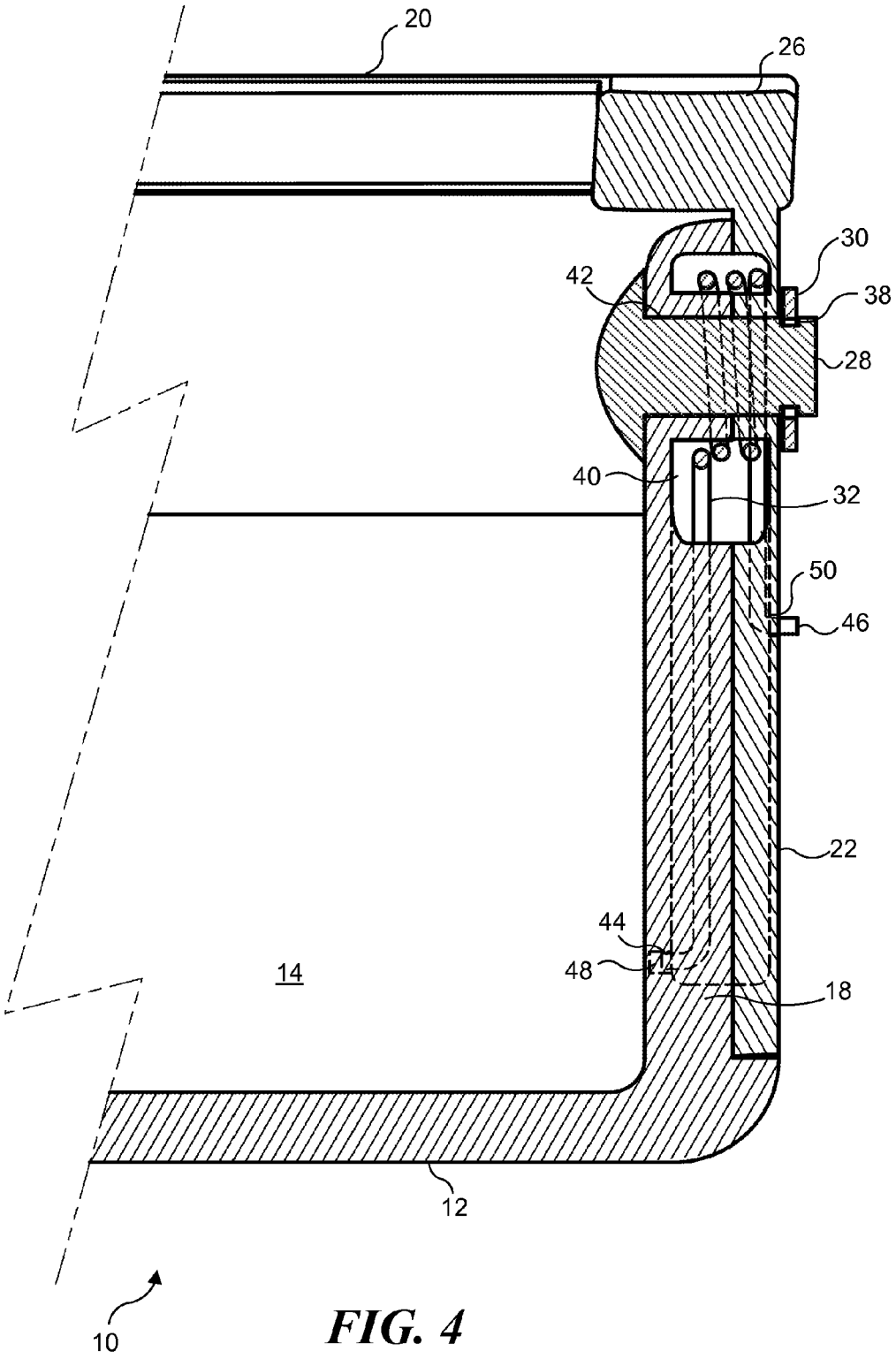
Figure 5:
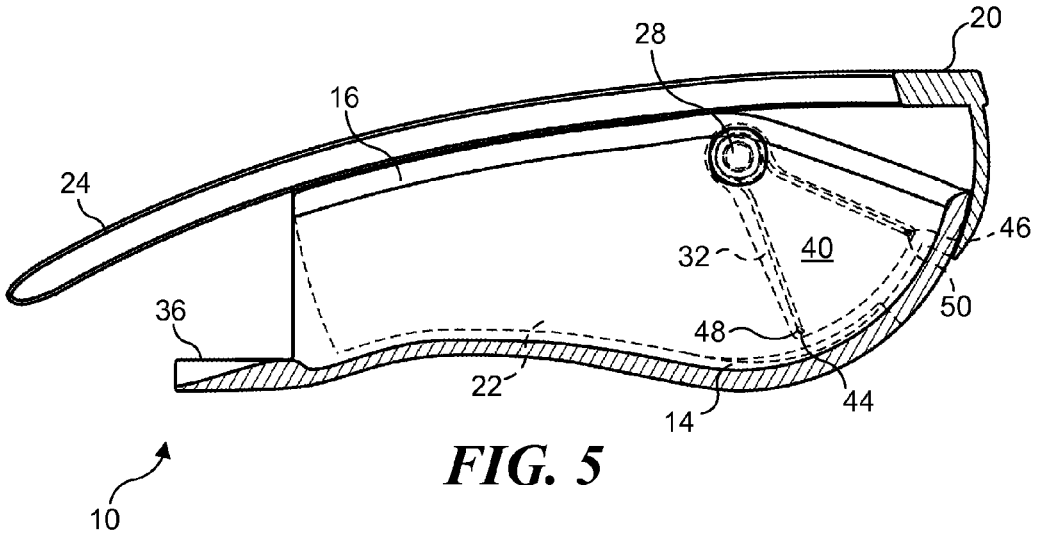
Figure 6:
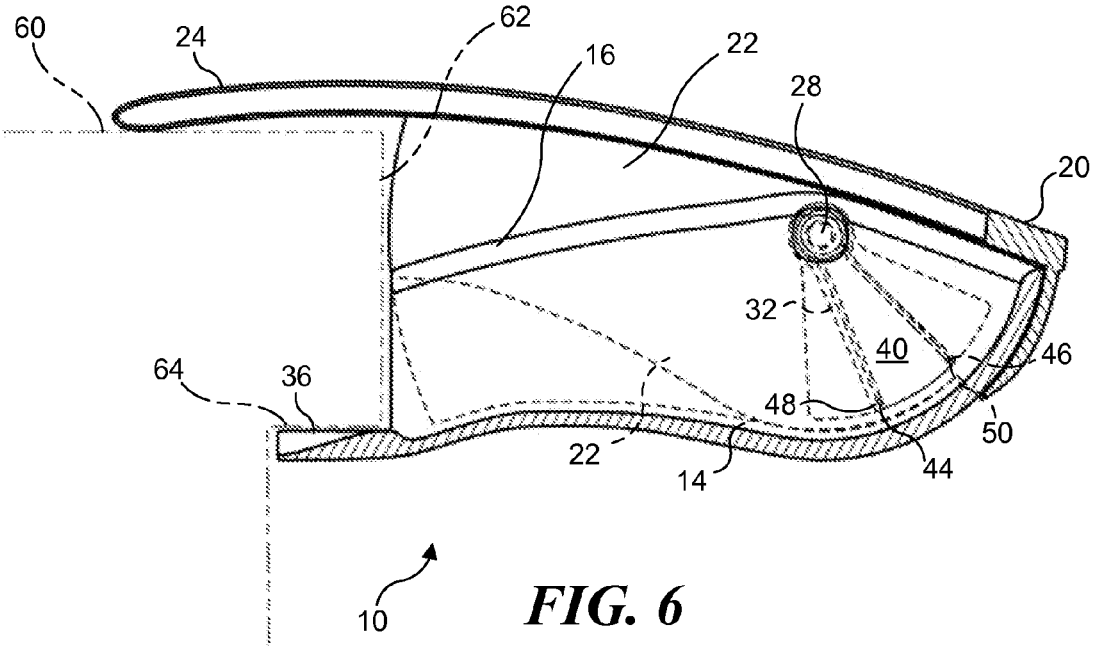
Figure 7:
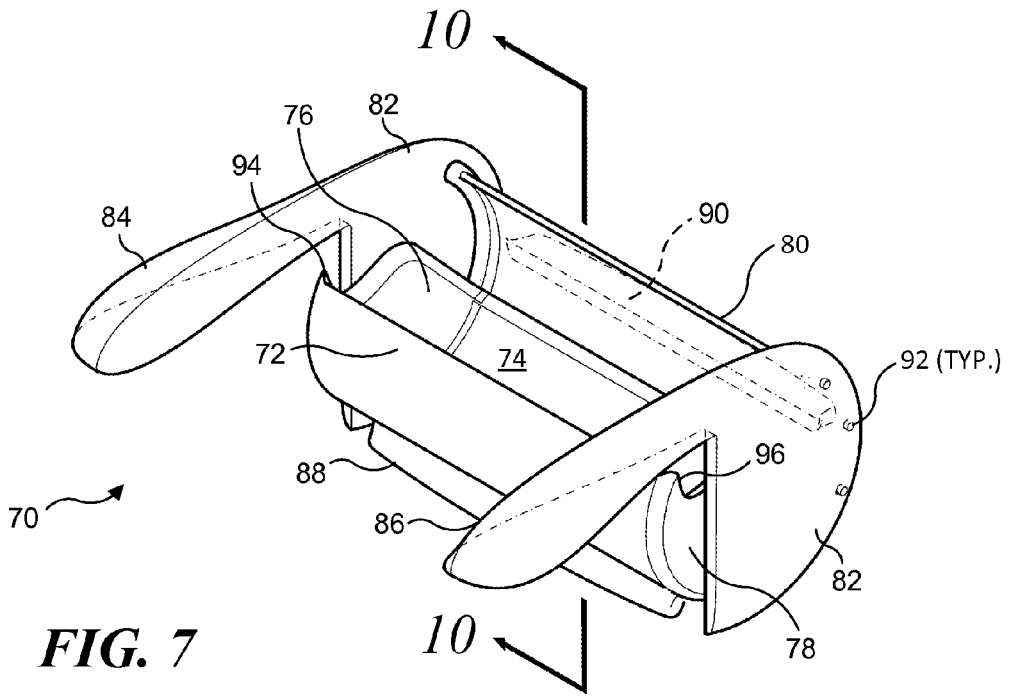
Figure 8:
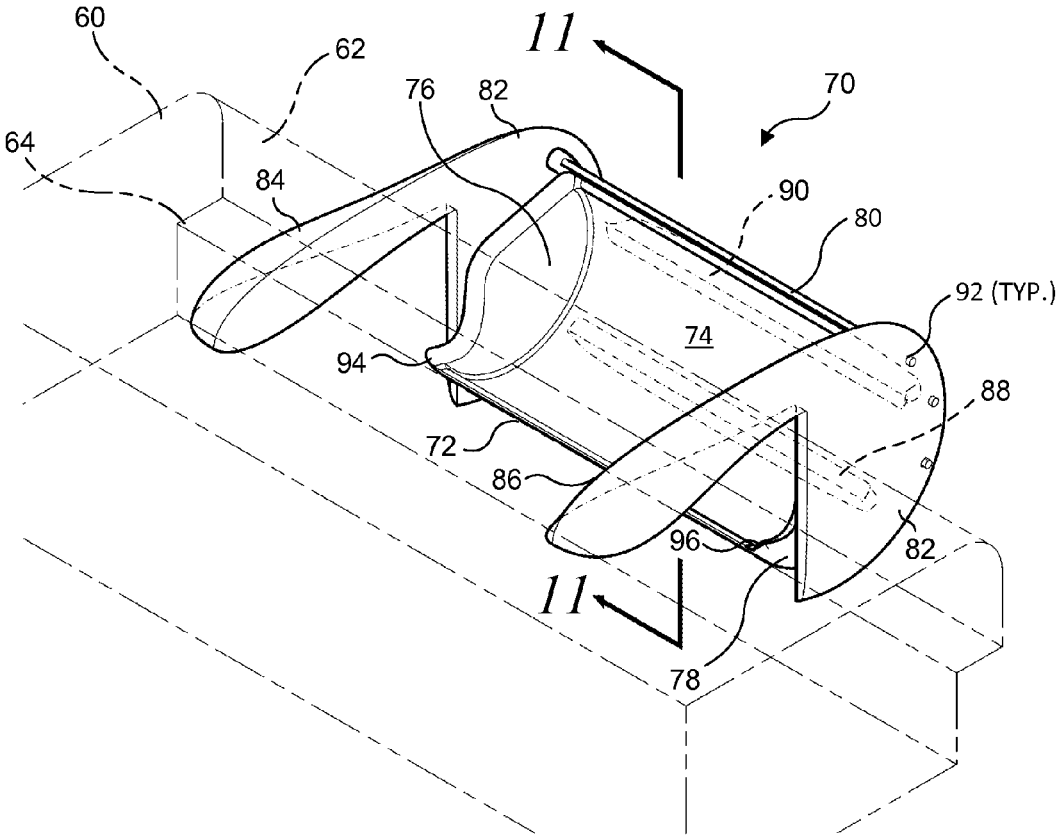
Figure 9:
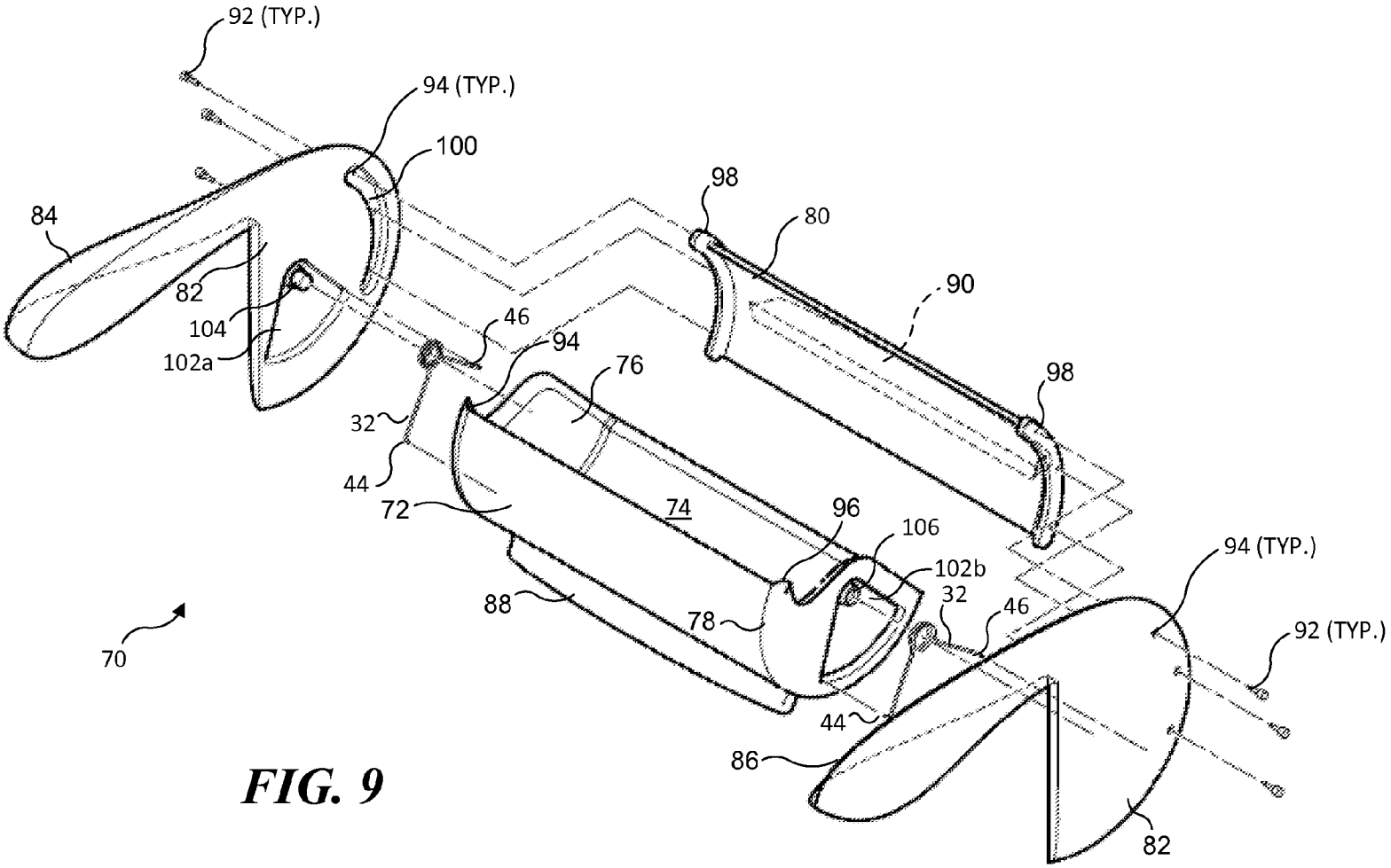
Figure 10:
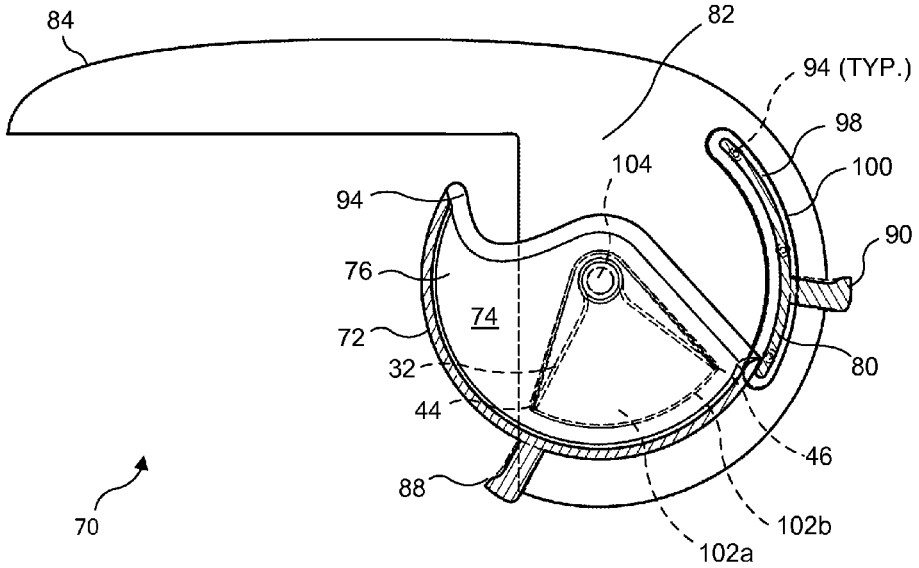
Figure 11:
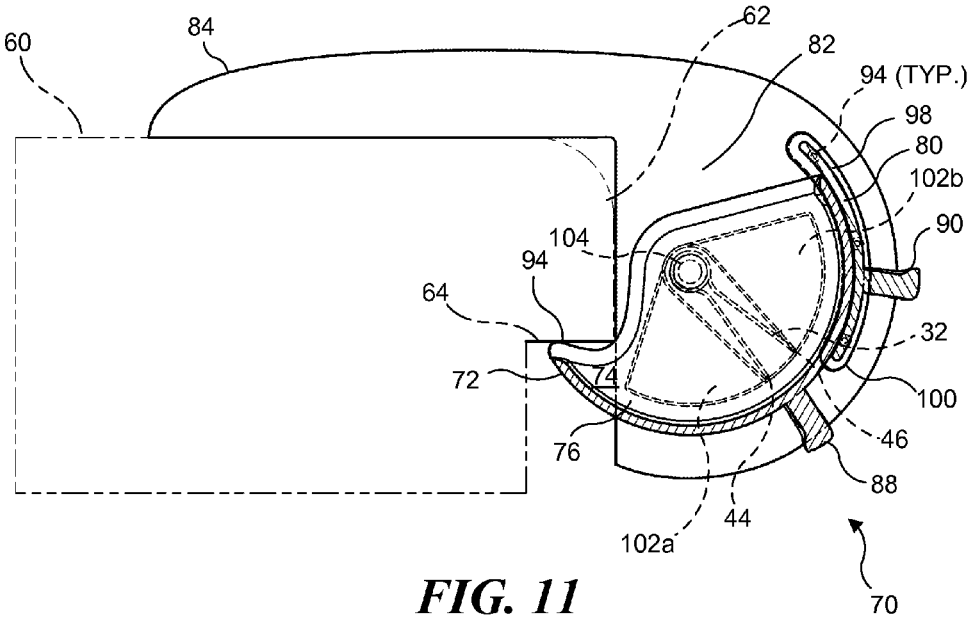
Figure 12:
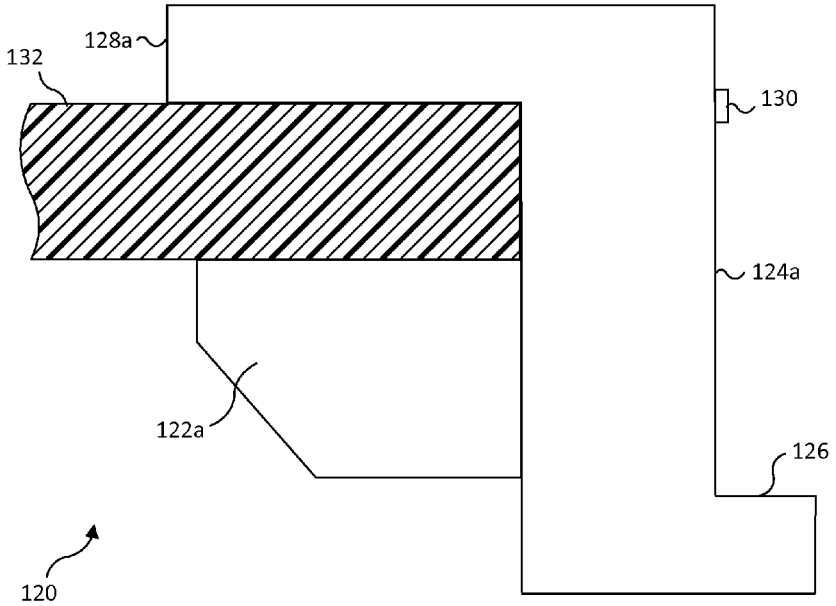
Figure 13:
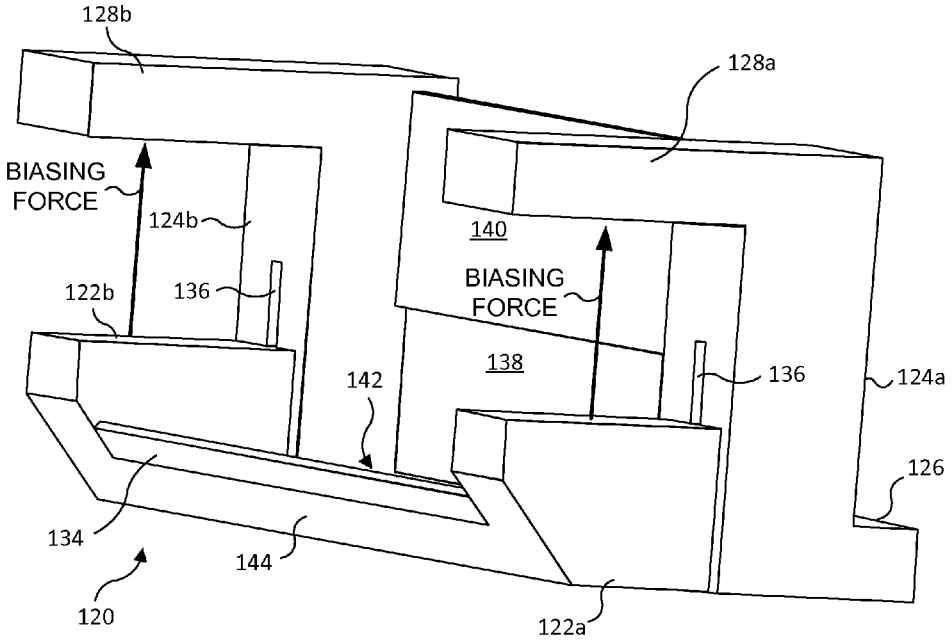
Figure 14:
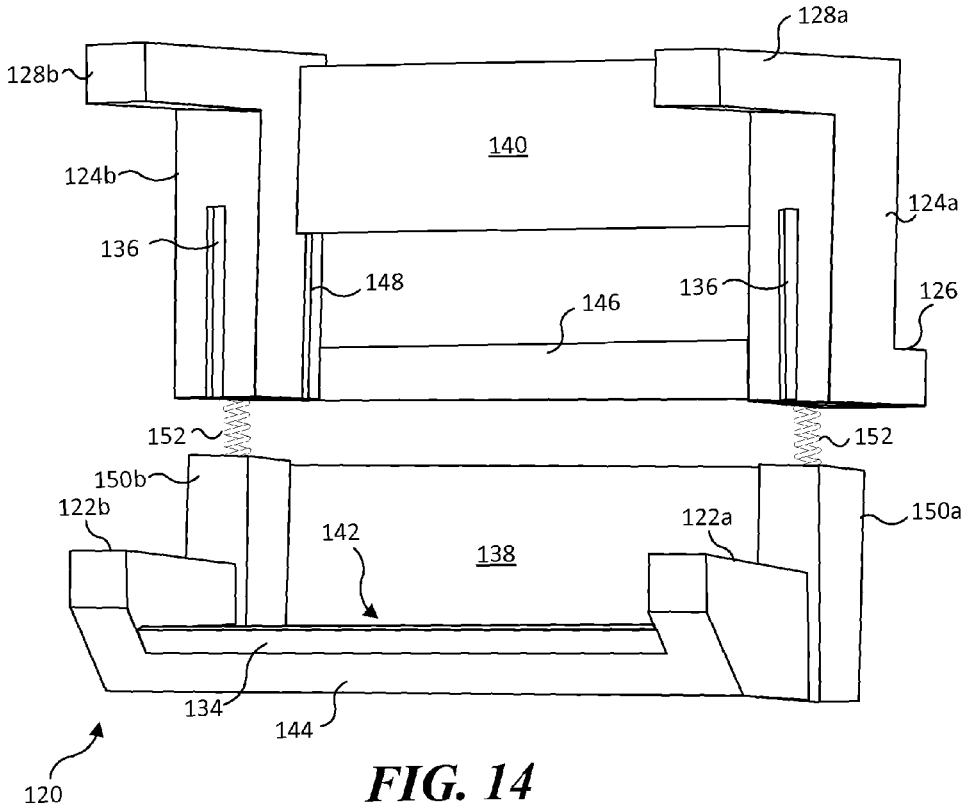
Figure 15:
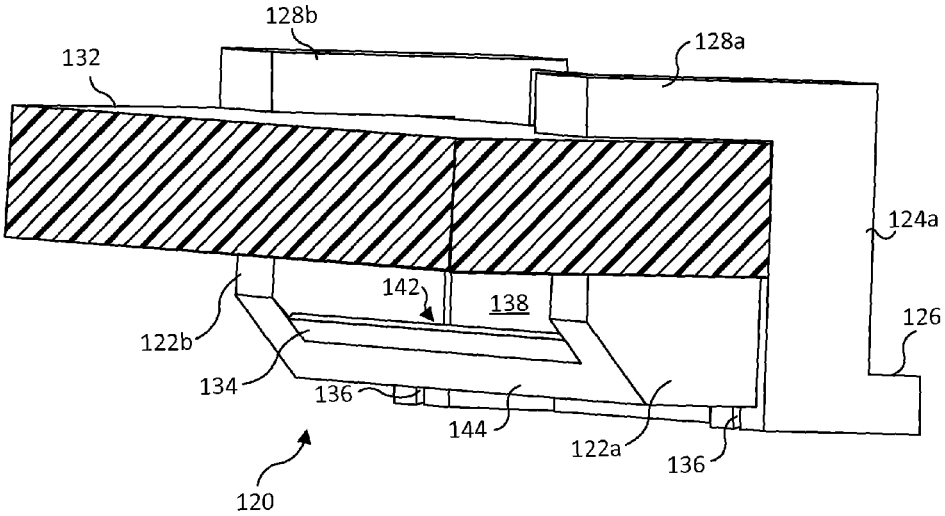
Figure 16:
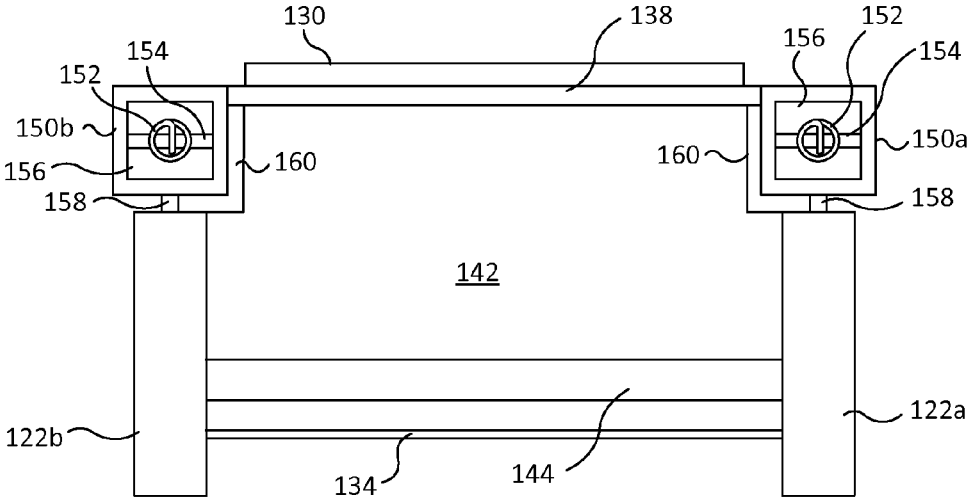
Figure 17:
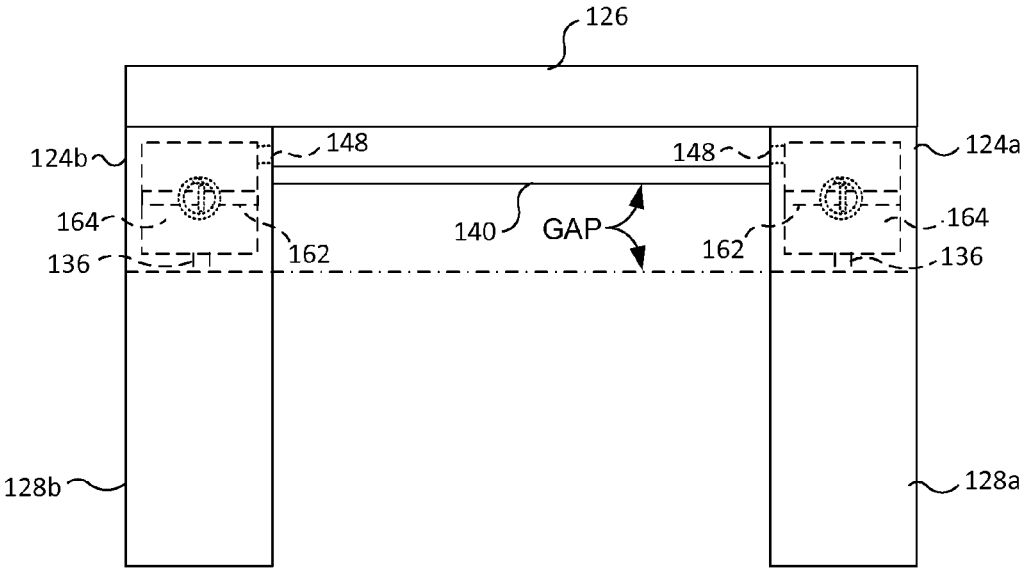

FIG. 3 is an exploded isometric view of the exemplary embodiment of FIGS. 1 and 2, illustrating how clamp arms on each side of the debris receptacle are pivotally attached to a receptacle portion by two pivot pins that capture helical springs used to bias the clamp arms toward lips extending outward from the lower sides of the receptacle portion, to removably affix the debris receptacle to the edge of a work surface;

FIG. 4 is an enlarged cut-away cross-sectional view of a portion of the right side of the debris receptacle of FIGS. 1-3, taken along section lines 4-4 in FIG. 1, showing details of the pivot pin and helical spring;

FIG. 5 is an elevational cross-sectional view of a side of the debris receptacle of FIGS. 1-4, taken along section lines 5-5 of FIG. 1, showing the clamp arm on that side biased to its full extent toward the lip on the side of the receptacle portion shown in this view;

FIG. 6 is an elevational cross-sectional view of the side of the debris receptacle shown in FIG. 5, taken along section lines 6-6 of FIG. 2, showing the clamp arm on that side and the lip on the side of the receptacle being used to clamp the debris receptacle to the lip of a work surface, which is shown in phantom view;

FIG. 7 is an isometric view of another exemplary embodiment of a debris receptacle, in which the receptacle pivots relative to fixed upper arms, to clamp to an edge of a counter, bench, or table;

FIG. 8 is an isometric view of the exemplary embodiment of FIG. 7, illustrating how the debris receptacle is attached to an edge of a counter, bench, or table, which is shown in phantom view;

FIG. 9 is an exploded isometric view of the exemplary embodiment of FIGS. 7 and 8, illustrating how the receptacle is pivotally attached to opposite sides so as to capture helical springs used to bias the pivoting receptacle toward the arms extending outward from each side of the debris receptacle, to removably affix the debris receptacle to the edge of a work surface;

FIG. 10 is an elevational cross-sectional view of a side of the debris receptacle of FIGS. 7-9, taken along section lines 10-10 of FIG. 7, showing the pivotal receptacle pivoted toward the arms to its fullest extent;

FIG. 11 is an elevational cross-sectional view of the side of the debris receptacle shown in FIGS. 7-10, taken along section lines 11-11 of FIG. 8, showing the arm on one side, and the lip on the pivoting receptacle on that side of the receptacle cooperating to clamp the debris receptacle to the lip of a work surface, which is shown in phantom view;

FIG. 12 is an side elevational view of an exemplary third embodiment of a debris receptacle, showing it clamped to a work surface (shown in cross-section), using opposing clamp arms that are biased toward each other;

FIG. 13 is an isometric view of the third embodiment of debris receptacle shown in FIG. 12;

FIG. 14 is an exploded view of the third embodiment of debris receptacle shown in FIGS. 12 and 13;

FIG. 15 is an isometric view of the third embodiment of the debris receptacle clamped to a work surface (shown in cross-section);

FIG. 16 is a top plan view of a lower portion of the third embodiment of the debris receptacle; and FIG. 17 is a top plan view of an upper portion of the third embodiment of the debris receptacle.

DESCRIPTION

Figures and Disclosed Embodiments Are Not Limiting

Exemplary embodiments are illustrated in referenced Figures of the drawings. It is intended that the embodiments and Figures disclosed herein are to be considered illustrative rather than restrictive. No limitation on the scope of the technology and of the claims that follow is to be imputed to the examples shown in the drawings and discussed herein. Further, it should be understood that any feature of one embodiment disclosed herein can be combined with one or more features of any other embodiment that is disclosed, unless otherwise indicated.

First Exemplary Embodiment of Removable Debris Receptacle

FIGS. 1-6 illustrate different views of a first exemplary embodiment of a debris receptacle 10 that is configured to be removably affixed to the edge of a work surface, such as a countertop, tabletop, or bench. As shown in FIG. 1, debris receptacle 10 includes a receptacle portion 12 having vertical sides 16 and 18 that are on opposite sides of a debris receiving volume 14. Attached to debris receptacle 10 is generally U-shaped component 20 having sides 22 that extend downwardly from clamp arms 24 and 26, outside the outer surfaces of vertical sides 16 and 18 (although this relationship can alternatively be reversed). Sides 22 are generally parallel to vertical sides 16 and 18 and extend only part way along clamp arms 24 and 26, so that the ends of the clamp arms can be used to clamp the debris receptacle to the edge of a work surface, as explained below. Pivot pins 28 rotatably couple sides 22 to vertical sides 16 and 18 at positions disposed above the deeper portion of debris receiving volume 14.

Pivot pins 28 extend through orifices 42 and are held in place by e-ring fasteners 30 that snap into a grooves 38, as shown best in FIGS. 3 and 4. In addition to pivotally coupling sides 22 to vertical sides 16 and 18, each pivot pin 28 also secures a helical coil spring 32 within a cavity 40 formed in the facing surfaces of sides 22 and vertical sides 16 and 18. An end 44 of helical coil spring 32 is bent outwardly and captured in an orifice 48 formed within vertical side 16 (a similar orifice is formed in vertical side 18), and an end 46 of the helical coil spring is bent outwardly, in a direction opposite that of end 44, and is captured in an orifice 50 on side 22. Helical coil springs 32 thus exert a biasing force that urges the extending end of clamp arm 24 toward a clamp surface 36, and the extending end of clamp arm 26 toward a clamp surface 34. When not affixed to the edge of a work surface, as shown in FIG. 5, the extending ends of the clamp arms are urged toward the clamp surfaces, and are spaced apart from the clamp surfaces by a minimum gap (which represents the minimum thickness of an edge of a work surface to which debris receptacle 10 can be affixed.) In contrast, FIG. 6 illustrates the clamp arms at their maximum separation from the clamp surfaces, which occurs when the maximum thickness edge of a work surface is being gripped.

As will be evident from the phantom view shown in FIGS. 2 and 6, the spring bias force produced by helical coil springs 32 causes an edge 62 of a work surface 60 to be gripped or clamped between the extending ends of clamp arms 24 and 26 and clamp surfaces 34 and 36. Since debris receptacle 10 and U-shaped component 20 are fabricated from a lightweight material such as ABS (Acrylonitrile, Butadiene and Styrene) or other polymer material suitable for injection molding, debris receptacle 10 is relatively light-weight and readily supported on edge 62 by the clamping force produced by helical coiled springs 32, that cause clamp arms 24 and 26 to cooperate with clamp surfaces 34 and 36 in gripping the edge.

While not shown in the Figures, it is noted that a gripping layer with a high frictional coefficient, such as rubber, or a substance that is characterized by having a tacky surface, may be applied to the undersurface of the extending ends of clamp arms 24 and 26, and optionally, also to clamp surfaces 34 and 36. The high friction coefficient will improve the grip of clamp arms 24 and 26 on the work surface and of clamp surfaces 34 and 36 on an undersurface 64 of the edge of the work surface to which debris receptacle 10 is removably affixed.

When debris receptacle 10 is affixed to the edge of a work surface, for example as shown in FIGS. 2 and 6, it will be apparent that a person can readily sweep debris from the work surface and into debris receiving volume 14, e.g., by using an edge of a hand, a sponge, a brush, a knife, or other appropriate tool. Debris and waste material is thus readily removed from the work surface and transferred into debris receiving volume 14 with minimal likelihood of the debris falling to the floor below. Once all of the debris has been removed from the work surface and into the debris receiving volume (either once or multiple times), debris receptacle 10 can readily be removed from edge 62 of work surface 60. To remove the debris receptacle from the edge of the work surface, a user can simply grasp the back edge of U-shaped component 20 and pull the debris receptacle away from the edge, or alternatively, lift clamp arms 24 and 26 to release the debris receptacle from its grip on the edge. The waste that is contained within debris receiving volume 14 can then be dumped into a waste container such as a garbage can or other suitable container. After dumping the debris from debris receptacle 10, clamp arms 24 and 26 can be lifted upwardly and the debris receptacle position at edge 62 of work surface 60 (as shown in FIGS. 2 and 6). Once the clamp arms are released and apply a clamping force on the work surface, debris receptacle 10 will again be positioned to receive debris swept from the work surface and into debris receiving volume 14.

Second Exemplary Embodiment of Removable Debris Receptacle

A second exemplary embodiment of a debris receptacle 70 is illustrated in various views shown in FIGS. 7-11. This second embodiment is somewhat more compact than debris receptacle 10, which was discussed above. Because debris receptacle 70 has a center of mass that is relatively close to an edge of a work surface to which the debris receptacle is removably attached than the center of mass of debris receptacle 10, debris receptacle 70 is more secure and less likely to be inadvertently knocked from the clamped position on the edge of the work surface. The functionality and many of the features of debris receptacle 70 are nevertheless similar to those of debris receptacle 10.

As shown in the isometric views of debris receptacle 70 in FIGS. 7 and 8, a debris receiving volume 74 is defined by a longitudinally extending curved surface 72 to which sides 76 and 78 are attached. Side 76 includes a clamping surface 96, and side 78 includes a clamping surface 94. The clamping surfaces are formed along an inner portion of the top edge of the respective sides of debris receiving volume 74.

As will be apparent in the discussion below, debris receiving volume 74 rotates around pivots points (not shown in FIGS. 7 and 8) provided internally within sides 76 and 78 and panels 82. Panels 82 depend downwardly relative to clamp arms 84 and 86. Clamp arms 84 and 86 are disposed at each end of debris receiving volume 74 and are configured so that when debris receptacle 70 is attached to the edge of a work surface, the inner ends of the clamp arms extend over the top of the work surface. For example, work surface 60 is shown in phantom view in FIG. 8, with debris receptacle 70 attached to edge 62. Panels 82 on clamp arms 84 and 86 are generally parallel to and aligned with the outer surfaces of sides 76 and 78. A crosspiece 80 extends generally horizontally at a rear (i.e., outer portion) of debris receptacle 70 and is formed to have a curved shape that generally matches at least a rear portion of curved surface 72. Crosspiece 80 connects to panels 82 using threaded fasteners 92.

FIG. 7 illustrates debris receptacle 70 when it is not attached to an edge of a work surface. In this state, debris receiving volume 74 is rotated so that clamping surfaces 94 and 96 are in their uppermost position and closest to clamp arms 84 and 86, respectively. In contrast, as shown in FIG. 8, debris receiving volume 74 is rotated so that clamping surfaces 94 and 96 rest on undersurface 64 at edge 62 of the work surface. As explained below, clamping surfaces 94 and 96 are urged toward clamp arms 84 and 86 by a biasing force. This biasing force thus clamps debris receptacle 70 on edge 62 of the work surface so that it is positioned to receive debris that is swept or otherwise moved from the work surface and into debris receiving volume 74. A user can remove debris receptacle 70 from the edge of a work surface by simply pulling the entire debris receptacle outwardly away from the edge. Alternatively, a user can manually rotate debris receiving volume 74 so that clamping surfaces 94 and 96 are moved away from undersurface 64 of edge 62. For this purpose, a lip 88 is attached along curved surface 72 and extends longitudinally along the curved surface. Similarly, a lip 90 is attached to crosspiece 80 and extends longitudinally along its rear or outer surface. Thus, a user can simply grasp lips 88 and 90 between the edge of a user's thumb and fingertips and squeeze lip 88 toward lip 90 to rotate clamping surfaces 94 and 96 away from clamp arms 84 and 86, thereby releasing the clamping force attaching debris receptacle 70 to the edge of the work surface.

With reference to the exploded isometric view of debris receptacle 70 shown in FIG. 9, further details of the exemplary embodiment are illustrated. For example, this view shows how threaded fasteners 92 pass through orifices 94 in panels 82 and are threaded into an arcuate flange 98, one of which is disposed at each end of crosspiece 80. Arcuate flange 98 fits within a corresponding arcuate cavity 100, which is formed in the inner sides of panels 82, so that the crosspiece is positioned in a desired disposition when attached to panels 82. Also, FIG. 9 clearly shows a sector-shaped cavity 102*a* formed on the inner sides of panels 82 and a corresponding sector-shaped cavity 102*b* formed on the outer surfaces of sides 76 and 78. Adjacent a vertex of sector-shaped cavity 102*a* is disposed a pivot pin 104. Seated over each pivot pin 104 is the coiled portion of one of helical coiled springs 32. Pivot pin 104 is inserted into orifice 106, which is disposed adjacent to the vertex of sector-shaped cavity 102*b*, retaining the helical coiled spring in position. Outwardly bent end 44 of the helical coiled spring extends into a corner of sector-shaped cavity 102*b*, while outwardly bent end 46 of the helical coiled spring extends in the opposite direction into a corner of sector-shaped cavity 102*a*—at each end of debris receiving volume 74. When panels 82 are secured with threaded fasteners 92 to crosspiece 80, helical coiled springs 32 are thus captured on pivot pin 104 in each pair of sector-shaped cavities 102*a* and 102*b*. Helical coiled springs 32 thus provide the biasing force that urges debris receiving volume 74 to rotate to the position shown in FIG. 7 when debris receptacle 70 is not clamped to an edge of a work surface, but when lips 88 and 90 are squeezed together, debris receiving volume 74 is rotated to move clamping surfaces 94 and 96 away from clamp arms 84 and 86, and the debris receptacle is positioned so that an edge of a work surface is disposed between the clamping surfaces and the clamp arms, and when manual force applied to lips 88 and 90 is released, helical coiled springs 32 then provide the biasing force that clamps debris receptacle 70 on the edge of the work surface, such as shown in the example of FIG. 8.

Further clarification is shown in the cross-sectional views illustrated in FIGS. 10 and 11. FIG. 10 is a cross-sectional view through FIG. 7 and shows debris receptacle 70 when it is not coupled to an edge of a work surface, so that clamping surface 94 is rotated upwardly to its fullest extent, where it is closest to clamp arm 84. FIG. 11 is a cross-sectional view through FIG. 8, showing clamping surface 94 seated on undersurface 64 of edge 62, so that debris receptacle is clamped onto the edge of the work surface. The change in the rotational position of sector-shaped cavity 102*b* relative to sector-shaped cavity 102*a* is readily evident by comparing these sector-shaped cavities in FIGS. 10 and 11. Also, the illustration in FIG. 11 clearly indicates how lips 88 and 90 can be squeezed together using the fingers and thumbs of one hand to place or remove debris receptacle 70 on edge 62 of work surface 60.

It is again contemplated that a material such as rubber, an elastomer, or other material or coating with a relatively high coefficient of friction may be applied to the undersurface of clamp arms 84 and 86 and to clamping surfaces 94 and 96 to increase the resistance of debris receptacle 70 from being inadvertently knocked loose from the edge of a work surface. The added increase in friction prevents these surfaces from readily sliding over the top of the work surface and undersurface 64 of the work surface.

It is also evident that further changes to the shape of debris receiving volume 74 and the other components can be implemented within the scope of the present novel approach. For example, it may be desirable to change the shape of the debris receiving volume so that is actually hangs below the edge of the work surface. This change might actually shift the center of mass of the debris receptacle under the edge of the work surface so that the debris receptacle is clamped to hang from the edge rather than to be cantilevered from the edge of the work surface.

Third Exemplary Embodiment of Removable Debris Receptacle

A third exemplary embodiment of a debris receptacle 120 in accord with the present novel approach is shown in FIGS. 12-17. FIG. 12 illustrates debris receptacle 120 clamped on an edge of a work surface 132 (shown is cross-sectional view). Debris receptacle 120 includes a pair of lower clamp arms 122*a* and 122*b*, which are both visible in FIG. 13. As shown in FIG. 13, the lower clamp arms are biased upwardly (relative to the view shown in this Figure), as indicated by the labeled arrows, so that the lower clamp arms tend to move toward a pair of upper clamp arms 128*a* and 128*b*. An upper rear panel 140 extends between columns 124*a* and 124*b*. The lower clamp arms slide within slots 136 formed in columns 124*a* and 124*b*, which support upper clamp arms 128, on each side of a debris receiving volume 142. Debris receiving volume 142 is formed on the top surface of a bottom panel 144. A front lip 134 that extends between lower clamp arms 122*a* and 122*b* and is attached at the front top edge of bottom panel 144 prevents debris collected in debris receiving volume 142 from spilling out while debris receptacle 120 is secured to the edge of a work surface.

As shown in FIGS. 12 and 13, a rear lower cross member 126 extends between columns 124*a* and 124*b*. A rear upper cross member 130 is disposed on the back surface of a rear sliding panel 138. Rear sliding panel 138 is attached to bottom panel 144 and connects to lower clamp arms 122*a* and 122*b* within columns 124*a* and 124*b*, as discussed below. By grasping rear lower cross member 126 and rear upper cross member 130 between a thumb and the fingers on one hand, a user can squeeze to apply a force opposing the biasing force, to move lower clamp arms 122*a* and 122*b* away from upper clamp arms 128*a* and 128*b*, thereby enabling debris receptacle to be attached to or released from a work surface. When thus removed from edge of a work surface, any debris collected in debris receiving volume 142 of debris receptacle 120 can readily be emptied into a suitable trash container, by inverting the debris receptacle over the trash container. Conversely, debris receptacle 120 can be attached to an edge of a work surface by enabling the biasing force to move lower clamp arms 122*a* and 122*b* toward upper clamp arms 128*a* and 128*b*, removably securing the debris receptacle to the edge of a work surface, so that debris can be readily swept from the top of the work surface into debris receiving volume 142. Upper rear panel 140 and rear sliding panel 138 overlap and direct debris into debris receiving volume 142 in the space formed between the edge of the work surface and upper rear panel 140.

An exploded view of debris receptacle 120 is shown in FIG. 14. This view provides more details showing how lower clamp arms 122*a* and 122*b* are biased toward upper clamp arms 128*a* and 128*b*. As shown in this Figure, lower clamp arm 122*a* is attached to an internal column 150*a*, while lower clamp arm 122*b* is attached to an internal column 150*b*. Rear sliding panel 138 extends between internal columns 150*a* and 150*b*. As discussed below (in connection with FIGS. 16 and 17), the connection between the lower clamp arms and the internal columns is through a sliding member 158 that is sized to slide freely (but snugly) within slots 136, which are formed in columns 124*a* and 124*b*. Similarly, rear sliding panel 138 is sized to a thickness that readily slides within slots 148. Slots 148 are formed on facing surfaces of the columns 124*a* and 124*b*. One end of helical springs 152 is disposed in the center of internal columns 150*a* and 150*b* and extends upwardly into columns 124*a* and 124*b*, where the opposite end of the helical springs is secured. Thus, helical springs 152 provide the biasing force that urges lower clamp arms 122*a* and 122*b* to move toward upper clamp arms 128*a* and 128*b*. This biasing force is applied between internal columns 150*a* and 150*b*, and columns 124*a* and 124*b*.

FIG. 15 illustrates again how lower clamp arms 122*a* and 122*b* and their attached internal column 150*a* and 150*b* employ the biasing force supplied by helical springs 152 to secure debris receptacle to work surface 132. Since the thickness of a work surface may vary, the length of slots 136 and 148 are selected to encompass an acceptable range of work surface surfaces, so that debris receptacle 120 can be clamped onto work surfaces having any thickness within that range.

The top plan view of the lower portion of debris receptacle 120 shown in FIG. 16 provides more details showing how one end of helical springs 152 is secured by pins 154 within a central volume 156 of internal columns 150*a* and 150*b*. Also shown are sliding members 158 that connect lower clamp arms 122*a* and 122*b* to internal columns 150*a* and 150*b*. Gaps 160 are formed in bottom panel 144 and extend around two adjacent sides of internal columns 150*a* and 150*b* and are sized to enable columns 124*a* and 124*b* to slide over the internal columns.

In the top plan view of the upper portion of debris receptacle 120 shown in FIG. 17, the internal configuration of columns 124*a* and 124*b* is evident by the dash (hidden) lines used to indicate the disposition of pins 162 within a central volume 164 of columns 150*a* and 150*b*, which is used to secure the upper ends of helical springs 152 to the columns. Also shown using dash (hidden) lines are slots 136 and 148 which respectively receive sliding members 158 and rear sliding panel 138. A dash-dot line shows where the front surface of columns 124*a* and 124*b* would contact an edge of a work surface, defining a gap between the edge of the work surface and upper rear panel 140 through which debris being swept or otherwise moved from the work surface can fall into debris receiving volume 142. Based on these drawings, it will be evident how the lower portion moves relative to the upper portion in response to the biasing force provided by helical springs 152, or in response to the manual force applied, for example, on rear lower cross member 126 and rear upper cross member 130, in opposition to the spring biasing force.

A contemplated alternative configuration would be to couple the upper clamp arms to internal columns and to couple the lower clamp arms to columns, so that the columns to which the lower clamp arms are coupled encompass the internal columns and slide relative to the internal columns to which upper clamp arms are coupled. In such an alternative configuration, upper rear panel 140 would slide within slots formed in the columns coupled to the lower clamp arms.

It will be evident that the sizing and details of debris receptacle 120 are merely exemplary and can readily be modified as desired, within the scope of this novel approach. For example, the size of debris receiving volume 142 can readily be changed to either increase or decrease its capacity by changing the distance between the upper and lower clamp arms, and/or by changing the distance between front lip 134 and rear sliding panel 138. Similarly, the depth of the debris receiving volume can readily be increased or decreased as desired by changing the height of the front lip and/or the vertical dimension of lower clamp arms 122*a* and 122*b*. The gap between the edge of the work surface and the front surfaces of upper rear panel 140 and rear sliding panel 138 through which debris is swept into debris receiving volume 142 can be changed by varying the sizes of columns 124*a* and 124*b* and internal columns 150*a* and 150*b*. Further, the biasing force can alternatively be provided by other devices such as elastomeric bands or other forms of springs, and by more than one spring in each of the columns, and the term "spring" as used herein, is intended to encompass all such mechanisms for providing the biasing force. While not shown in the drawings, it is also contemplated that a material having a relatively high coefficient of friction can be applied to the opposing facing surfaces (i.e., clamping surfaces) of lower clamp arms 122*a* and 122*b*, and upper clamp arms 128*a* and 128*b*, to improve the frictional "grip" resulting from the clamping force applied by the clamp arms to secure debris receptacle 120 to the work surface.

There are several advantages to using debris receptacles 10, 70, or 120 instead of other alternatives for collecting debris from a work surface. Specifically, debris receptacles 10, 70, and 120 can easily be attached and detached to and from work surfaces of varying thicknesses and or compositions, and these operations can be repeated within the same cleaning timeframe or as desired. For example, when cleaning up after a meal, the user might wish to clean a dinner table, a buffet, and kitchen counters, which can readily be done by attaching the debris receptacle to each work surface in succession and sweeping the debris particles from the respective work surfaces into the debris receptacle. In addition, use of the debris receptacle frees both of the user's hands to clean and move objects (for example, small appliances, food canisters, seasoning container, etc.) that are to remain on the work surface being cleaned, all while sweeping or otherwise clearing the debris and particulates from that work surface into the receptacle. The compact design of debris receptacles 10, 70, and 120 enables a user to move around them without impeding access to a targeted work surface for other purposes.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The invention in which an exclusive right is claimed is defined by the following:

1. A debris receptacle that is removably secured to an edge of a work surface, comprising:

(a) a debris receiving volume defined by two lower clamp arms comprising sides of the debris receiving volume, a rear surface, and a bottom surface, where the lower clamp arms are coupled to the rear surface and the bottom surface to enclose a lower portion of the debris receiving volume where the rear surface and sides contact the bottom surface, to retain debris that is moved into the debris receiving volume;

(b) two upper clamp arms that are coupled to the debris receiving volume, each upper clamp arm extending adjacent to and overlying a different one of the lower clamp arms, the upper clamp arms and the lower clamp arms that are thus disposed in opposition to each other being movable relative to each other; and (c) a plurality of springs, including at least one spring coupled to each of the lower clamp arms and to each of the upper clamp arms, the plurality of springs applying a biasing force to urge the lower clamp arms toward the upper clamp arms, so that the biasing force causes the lower clamp arms and the upper clamp arms to grip opposite surfaces of a work surface along an edge of the work surface, to removably clamp and secure the debris receptacle at the edge of the work surface in a position to receive debris that is moved from the work surface and falls into the debris receiving volume.

2. The debris receptacle of claim 1, wherein the lower clamp arms and the upper clamp arms that are disposed in opposition to each other are coupled to columns that slidingly mate together, so that the biasing force causes the columns to which the lower clamp arms are coupled to slide relative to the columns to which the upper clamp arms are coupled.

3. The debris receptacle of claim 2, wherein one of the columns to which one of the lower clamp arms and one of the upper clamp arms is coupled slides within the column to which another of the lower clamp arms and upper claim arms is coupled.

4. The debris receptacle of claim 3, wherein each of the plurality of springs comprises a helical spring, one end of each helical spring being connected within one of the columns coupled to one of the lower clamp arms, and another end of the helical spring being connected within one of the columns coupled to the upper clamp arm overlying said one of the lower clamp arms.

5. The debris receptacle of claim 2, wherein the rear surface comprises a first panel that extends between the columns coupled to the lower clamp arms.

6. The debris receptacle of claim 5, wherein the rear surface further comprises a second panel that extends between the columns coupled to the upper clamp arms, the first panel and the second panel moving adjacent to each other in partially overlapping relationship as the lower clamp arms and the upper clamp arms move relative to each other.

7. The debris receptacle of claim 6, wherein the one column that encompasses the other column includes:

(a) a first slot in which a member coupling the other column to either the lower clamp arm or the upper clamp arm slides when the lower clamp arms move relative to the upper clamp arms; and (b) a second slot in which either the first panel or the second panel slides when the lower clamp arms move relative to the upper clamp arms.

8. The debris receptacle of claim 5, further comprising an upper rear cross member attached to the columns coupled to the upper clamp arms, and a lower rear cross member attached to the first panel, wherein a manual force applied to squeeze the upper rear cross member toward the lower rear cross member is in opposition to the biasing force applied by the plurality of springs, enabling the lower clamp arms to be forced away from the opposing upper clamp arms to either enable the debris receptacle to be placed on and secured to a work surface, or to be removed from a work surface.

9. The debris receptacle of claim 2, wherein the plurality of springs are disposed within the columns coupled to the lower clamp arms and the upper clamp arms.

10. The debris receptacle of claim 2, wherein a surface of one of the columns coupled to each of the opposing lower clamp arms and upper clamp arms is disposed adjacent to an edge of the work surface when the debris receptacle is removably clamped and secured to the work surface, a gap thus defined between the edge of the work surface and the rear panel enabling debris moved from the work surface toward the rear panel to fall into the debris receiving volume.

11. A method for enabling a debris receptacle to be removably attached to and supported by an outwardly extending edge of a work surface so as to enable debris on the work surface to be swept into the debris receptacle, comprising:

(a) providing lower clamp arms disposed at each side of a debris receiving volume, the lower clamp arms being able to extend under the work surface when the debris receptacle is disposed adjacent to an edge of the work surface with a portion of the debris receiving volume underlying the work surface, and the debris receptacle being configured with a bottom, a back, and sides that retain debris swept into the debris receiving volume from the work surface;

(b) providing upper clamp arms disposed in opposition to the lower clamp arms and sized to extend over a top surface of the work surface when the debris receptacle is disposed at the edge of the work surface; and (c) applying a biasing force between the lower clamp arms and the upper clamp arms that tends to move the lower clamp arms relative to the upper clamp arms, to compress and clamp the edge of the work surface between the lower and upper clamp arms, removably securing and supporting the debris receptacle on the edge of the work surface, and thus, providing an unobstructed path enabling debris on the work surface to readily be moved from the work surface, by sweeping the debris from the work surface directly into the debris receiving volume.

12. The method of claim 11, wherein applying the biasing force comprises providing a plurality of springs that couple between a lower portion of the debris receptacle and an upper portion of the debris receptacle at a first point disposed beyond the edge of the work surface.

13. The method of claim 12, further comprising enabling the debris receptacle to be removed from or clamped to the edge of the work surface by manually moving the lower portion relative to the upper portion so that the lower clamp arms move apart relative to the upper clamp arms.

14. The method of claim 11, wherein the lower clamp arms move relative to the upper clamp arms when columns to which the lower clamp arms are coupled slide relative to columns to which the upper clamp arms are coupled.

15. The method of claim 14, further comprising enabling columns coupled to one of the lower clamp arms and the upper clamp arms to slide within columns coupled to another of the lower clamp arms and the upper clamp arms.

16. The method of claim 14, further comprising providing a gap disposed between a rear panel connects the columns coupled to the upper clamp arms and the edge of the work surface through which debris on the work surface can be moved into the debris receiving volume.

17. The method of claim 16, further comprising providing a front lip on a bottom of the debris receiving volume that is positioned below the work surface, the front lip serving to retain debris that has been moved from the work surface into the debris receiving volume.

18. The method of claim 11, further comprising the step of including a gripping layer with a high frictional coefficient, on portions of either or both of the lower clamp arms and the upper clamp arms.

19. A debris receptacle that is removably attachable to an edge of a work surface, comprising:

(a) a debris receiving volume that is defined by a lower surface, a rear panel, and inside facing surfaces of a pair of lower clamp arms, a top of the debris receiving volume being open to receive debris swept into the debris receiving volume, the lower surface, the rear panel, and the inside facing surfaces being configured to retain the debris that is swept from the work surface within the debris receiving volume;

(b) a pair of upper clamp arms that are coupled together by a crosspiece and by the rear panel; and (c) a plurality of springs that provide a biasing force to urge the lower clamp arms toward the upper clamp arms, to grip an edge of a work surface and secure the debris receptacle to the edge of the work surface so that debris can readily be moved from the work surface and into the debris receiving volume, where the debris is retained until the debris receptacle is emptied.

20. The debris receptacle of claim 19, further comprising a lower portion that includes the pair of lower clamp arms, and a pair of internal columns, each internal column being coupled to a different one of the pair of lower clamp arms.

21. The debris receptacle of claim 20, further comprising an upper portion that includes the pair of upper clamp arms and a pair of columns that encompass the pair of internal columns and which are connected to the upper clamp arms.

22. The debris receptacle of claim 21, wherein the pair of lower clamp arms are each coupled to a different one of the internal columns by sliding members, each sliding member sliding within a first slot formed in one of the columns connected to one of the upper clamp arms, when the pair of lower clamp arms move relative to the pair of upper clamp arms.

23. The debris receptacle of claim 22, wherein each of the pair of columns includes a second slot within which a sliding panel that connects the pair of lower clamp arms slides when the lower clamp arms move relative to the upper clamp arms.

24. The debris receptacle of claim 21, wherein the plurality of springs comprise helical springs that are disposed within and connect the internal columns and the columns.

25. A debris receptacle that is removably secured to an edge of a work surface, comprising:

(a) a debris receiving volume defined by two lower clamp arms comprising sides of the debris receiving volume, a rear surface, and a bottom surface, where the lower clamp arms are coupled to the rear surface and the bottom surface;

(b) two upper clamp arms that are coupled to the debris receiving volume, each upper clamp arm extending adjacent to and overlying a different one of the lower clamp arms, the upper clamp arms and the lower clamp arms that are thus disposed in opposition to each other being movable relative to each other; and (c) a plurality of springs, including at least one spring coupled to each of the lower clamp arms and to each of the upper clamp arms, the plurality of springs applying a biasing force to urge the lower clamp arms toward the upper clamp arms, so that the biasing force causes the lower clamp arms and the upper clamp arms to grip opposite surfaces of a work surface along an edge of the work surface, to removably clamp and secure the debris receptacle at the edge of the work surface in a position to receive debris that is moved from the work surface and into the debris receiving volume, wherein the lower clamp arms and the upper clamp arms that are disposed in opposition to each other are coupled to columns that slidingly mate together, so that the biasing force causes the columns to which the lower clamp arms are coupled to slide relative to the columns to which the upper clamp arms are coupled.

26. A method for enabling a debris receptacle to be removably attached to and supported by an outwardly extending edge of a work surface, comprising:

(a) providing lower clamp arms disposed at each side of a debris receiving volume, the lower clamp arms being able to extend under the work surface when the debris receptacle is disposed adjacent to an edge of the work surface;

(b) providing upper clamp arms disposed in opposition to the lower clamp arms and sized to extend over a top surface of the work surface when the debris receptacle is disposed at the edge of the work surface; and (c) applying a biasing force between the lower clamp arms and the upper clamp arms that tends to move the lower clamp arms relative to the upper clamp arms, to compress and clamp the edge of the work surface between the lower and upper clamp arms, wherein the lower clamp arms move relative to the upper clamp arms when columns to which the lower clamp arms are coupled slide relative to columns to which the upper clamp arms are coupled, removably securing and supporting the debris receptacle on the edge of the work surface, and thus, enabling debris on the work surface to readily be moved from the work surface into the debris receiving volume.

27. A debris receptacle that is removably attachable to an edge of a work surface, comprising:

(a) a debris receiving volume that is defined by a lower surface, a rear panel, and inside facing surfaces of a pair of lower clamp arms;

(b) a pair of upper clamp arms that are coupled together by a crosspiece and by the rear panel;

(c) a lower portion that includes the pair of lower clamp arms, and a pair of internal columns, each internal column being coupled to a different one of the pair of lower clamp arms; and (d) a plurality of springs that provide a biasing force to urge the lower clamp arms toward the upper clamp arms, to grip an edge of a work surface and secure the debris receptacle to the edge of the work surface so that debris can readily be moved from the work surface and into the debris receiving volume.

* * * * *